US009695997B1

(12) United States Patent
Janczak

(10) Patent No.: US 9,695,997 B1
(45) Date of Patent: Jul. 4, 2017

(54) LED MASON JAR CANDLE

(71) Applicant: MerchSource, LLC, Irvine, CA (US)

(72) Inventor: Kristy Janczak, Irvine, CA (US)

(73) Assignee: MerchSource, LLC, Irvine, CA (US)

( * ) Notice: Subject to any disclaimer, the term of this patent is extended or adjusted under 35 U.S.C. 154(b) by 0 days.

(21) Appl. No.: 14/587,708

(22) Filed: Dec. 31, 2014

Related U.S. Application Data

(60) Provisional application No. 61/922,628, filed on Dec. 31, 2013.

(51) Int. Cl.

| | |
|---|---|
| ***C11C 5/00*** | (2006.01) |
| ***F21S 6/00*** | (2006.01) |
| ***F21S 9/02*** | (2006.01) |
| ***F21V 21/00*** | (2006.01) |
| *F21Y 101/02* | (2006.01) |

(52) U.S. Cl.
CPC ..... *F21S 9/02* (2013.01); *C11C 5/008* (2013.01); *F21S 6/00* (2013.01); *F21V 21/00* (2013.01); *F21Y 2101/02* (2013.01)

(58) Field of Classification Search
CPC ..... C11C 5/008; C11C 5/023; C11C 5/006; F21S 6/001; F21S 10/04–10/046; F21S 9/02
See application file for complete search history.

(56) References Cited

U.S. PATENT DOCUMENTS 3,572,564 A * 3/1971 Fleming ..... C03B 33/14 225/103
3,886,252 A * 5/1975 Eker ..... C11C 5/02 264/132
6,491,517 B2 * 12/2002 Freeman ..... C11C 5/008 362/161
7,736,145 B1 * 6/2010 Horvath ..... F23D 3/34 264/247
2005/0207171 A1 * 9/2005 McCavit ..... F21S 6/001 362/392

FOREIGN PATENT DOCUMENTS

DE 202011052464 U1 * 2/2012 ..... F21L 4/00

OTHER PUBLICATIONS

Machine translation of DE 202011052464 U1, retrieved Mar. 30, 2016 from www.epo.org.*

* cited by examiner

*Primary Examiner* — Anh Mai
*Assistant Examiner* — Steven Horikoshi
(74) *Attorney, Agent, or Firm* — Avyno Law P.C.

(57) ABSTRACT

A flameless candle molded into a jar is described. The jar is designed with an open bottom and is tooled for engagement with an electronic insert having batteries, control circuitry and at least one LED light. A candle is then formed in the jar with the electronic insert by molding a candle shell along the sidewalls of the jar. The candle shell is formed such that the sidewalls extend above the LED light of the electronic insert to allow the LED light to illuminate at a position below the sidewalls. The wax or waxen shell is formed only along the sidewalls, creating a hollow region above the electronic insert. Once the wax on the sidewalls sets, wax is then poured in the hollow regions above the electronic insert to a position just below or above the LED light.

2 Claims, 6 Drawing Sheets

LED MASON JAR CANDLE

CROSS-REFERENCE TO RELATED APPLICATIONS

This application claims priority of U.S. Provisional Patent Application Ser. No. 61/922,628, filed on Dec. 31, 2013, titled LED MASON JAR CANDLE, which application is incorporated by reference in this application in its entirety.

BACKGROUND OF THE INVENTION

1. Field of the Invention

The application relates to flameless candles and, in particular, to methods and systems for molding flameless candles within glass jars having battery and/or electrical compartments on the bottom of the jar.

2. Related Art

Candles having light emitting diodes (LEDs) are increasingly popular for both home and commercial use. Such LED candles have become known as flameless candles. The flameless candle designs use candle shells that have wax or waxen material. The use of these waxen shells allows the flameless candle to appear more like a traditional candle while being relatively inexpensive to produce as compared to traditional candles.

Generally, the flameless candles have hollow regions within the candle body, which also decreases the manufacturing cost of the candle. Electronic inserts are placed, at least partially, into the hollow portions of the candle shell. Electronic inserts generally include at least one LED, a circuit board, and a power source. Circuitry may also be included that creates a flickering effect, making the candle appear more realistic.

Inserting the electronics into the hollow insert of the shell involves more than one step. For example, the candle shell is first molded. Electronics are then inserted into the hollow portion of the candle shell. Subsequently, hot wax or another sealant can be added between the electronic insert and the candle shell to secure the electronic insert to the candle shell.

More recently, it has become desirable to include flameless candles within containers or jars. This has added a different level of complexity to the manufacturing process. As a result, the jar walls have replaced the candle shell walls, resulting in a more basic candle design being constructed within the jars. This more basic design is, however, less realistic in appearance. In particular, the candle designs in current jars lack the realistic depression commonly formed within real candles. This is a less desirable design because it not only lacks the depression but also causes the LED, when positioned above the wax line, to be clearly visible through the sides of the jar when the jar walls are clear. Having the LED clearly visible through the jar walls detracts from the realistic appearance of the candle. It is therefore desirable to have a candle design with a depressed flame below the sidewalls of the candle within the jar to create a more realistic appearance.

A need therefore exists for a method of manufacturing a flameless candle within a jar that provides for the candle shell sidewalls to extend upward within the jar, allowing for the flame to appear in a depression within the candle, rather than even with, or above, the candle.

SUMMARY

A flameless candle molded into a jar is claimed, depicted, and described. The jar has an open bottom tooled with a ring hole for engaging an electronic insert positioned at the bottom of the jar. The electronic insert includes batteries, control circuitry and at least one LED light. Within the jar, a candle shell is formed along the sidewalls of the jar. The candle shell has an open center or hollow region above the electronic insert. The sidewalls of the candle shell are formed to extend above the LED light of the electronic insert to allow the LED light to illuminate at a position below the sidewalls. A separate wax center portion fills the hollow regions above the electronic insert to a position just below or above the LED light yet below the top of the sidewalls of the candle shell.

A method for making a flameless candle in a jar is also claimed, depicted, and described. According to the method, the tooled ring hole opening in a bottom of the jar receives the electronic insert that engages with the ring hole of the jar through an engagement mechanism. Such engagement mechanism may be a friction or snap fit. A silicone mold is then inserted in the jar to create the wax sidewalls of the candle within the jar. The mold may provide for the walls to have flat top. Liquid wax is then poured into the mold to a point above the LED light. The wax is then allowed to cool. The silicone mold is removed and additional wax is poured above the electronic insert to a position just above or below the LED but lower than the top of the sidewalls.

Alternatively, the sidewalls can be poured first with a silicone mold insert and then the electronic insert can be inserted into the jar through an engagement mechanism. Additional wax is then poured over the electronic insert to a position just above or below the LED but lower than the top of the sidewalls.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
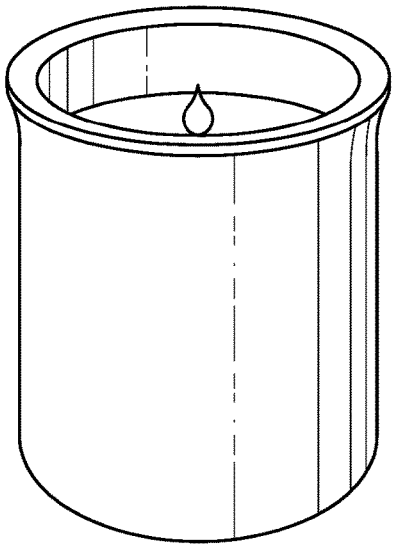
FIG. 1 (Prior Art)
FIG. 1 is prior art flameless candle in a jar illustrating the illuminating element positioned above the top of the waxen material in the jar.

FIG. 1 is a prior art flameless candle in a jar illustrating the illuminating element positioned above the top of the waxen material in the jar. As illustrated, creating a flameless candle within a jar is somewhat difficult and is typically done by filling an opened bottomed jar having an electronic insert position in the bottom with a waxen material to a fill line. The waxen material is formed entirely around the electronic insert and holds the electronic insert within the jar. The waxen material is generally filled to a point just below the illuminating mechanism of the flameless candle but may be filled above the LED when an ornamental wick is used just above the LED.

Figure 2:
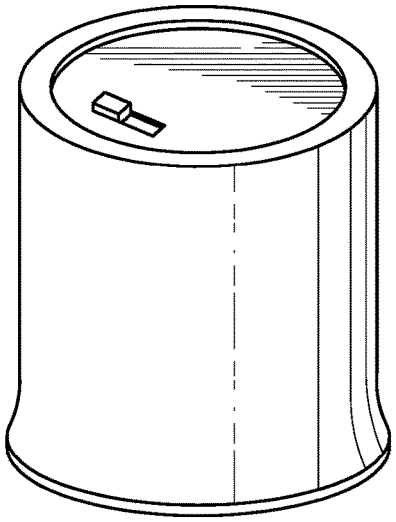
FIG. 2 (Prior Art)
FIG. 2 is the bottom of the prior art flameless candle in FIG. 1 illustrating the electronic insert positioned at the bottom of the jar.

FIG. 2 is the bottom of the prior art flameless candle in FIG. 1 illustrating the electronic insert positioned at the bottom of the jar. As illustrated in FIG. 2, the wax material is formed around the electronic insert between the jar walls to hold the electronic insert in position at the bottom of the jar.

Figure 3:
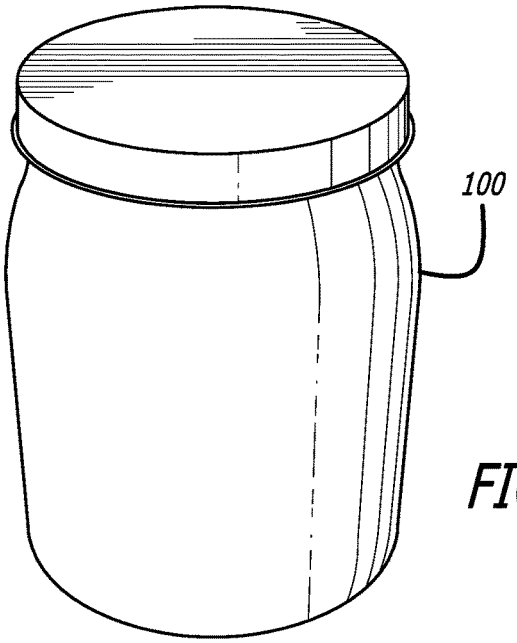
FIG. 3 is a perspective top view of a flameless candle in a jar that is designed in accordance with the present invention.
Figure 4:
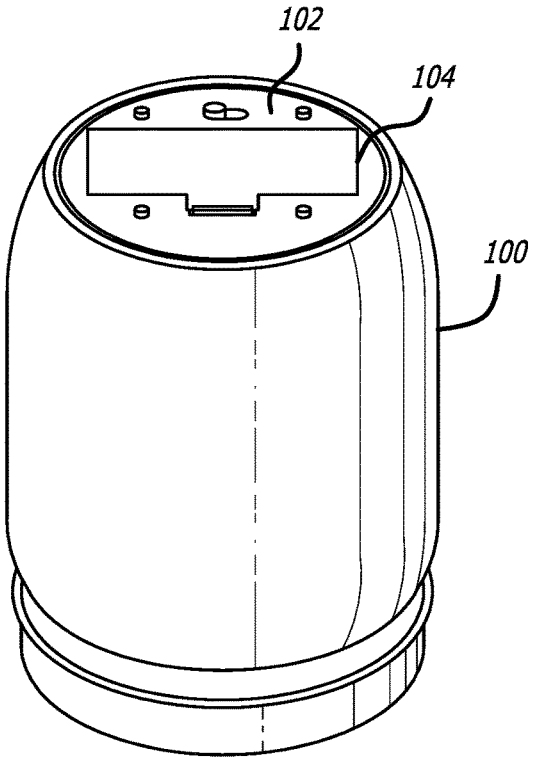
FIG. 4 is a bottom perspective view of the flameless candle of FIG. 3.
Figure 5:
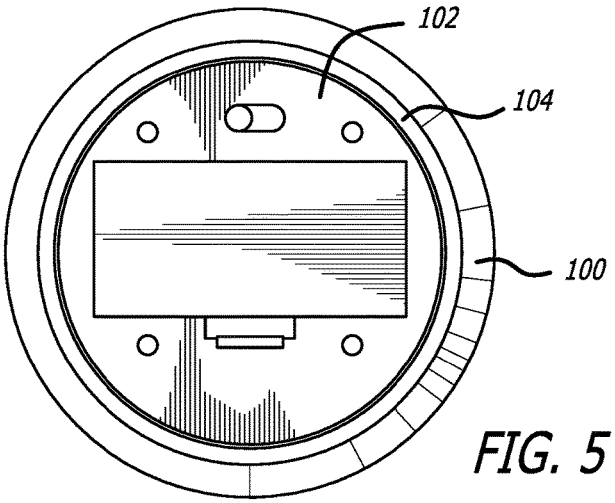
FIG. 5 is a bottom view of the flameless candle of FIG. 3.

FIG. 3 is a perspective top view of a flameless candle in a jar 100 that is designed in accordance with the present invention. FIGS. 4 and 5 illustrate a bottom perspective view and bottom view of the flameless candle of FIG. 3 illustrating the jar 100 having an open bottom defined by a ring hole 104 for receiving an electronic insert 102.

Figure 6:
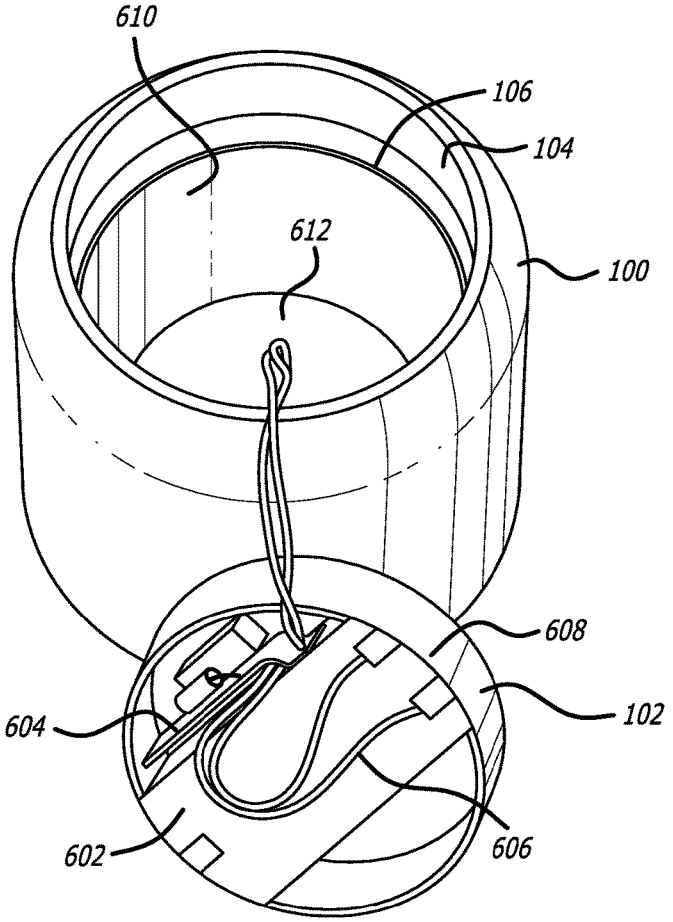
FIG. 6 is a bottom perspective view of the flameless candle of FIG. 3 with part of the electronic insert removed.
Figure 7:
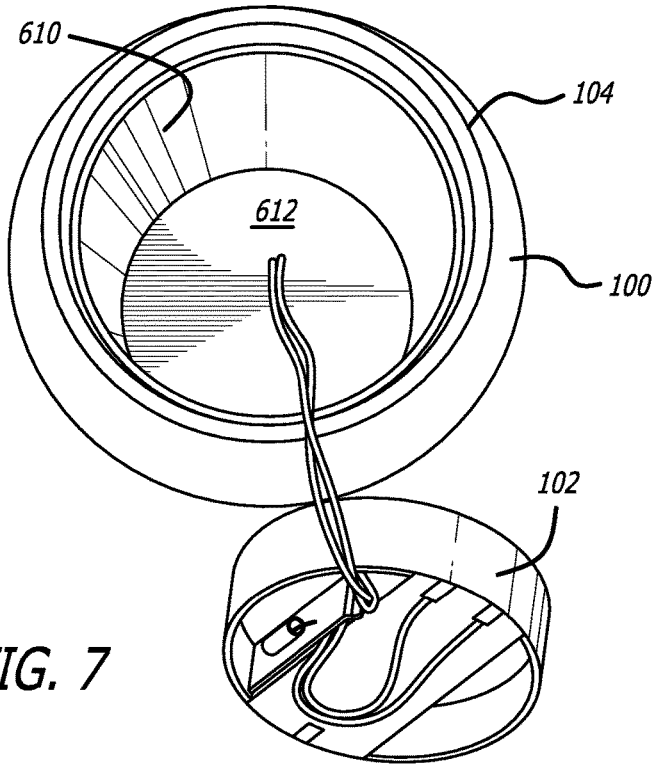
FIG. 7 is a bottom view of the flameless candle of FIG. 6.

FIGS. 6 and 7 illustrate a bottom perspective view and bottom view of the flameless candle of FIG. 3 with part of the electronic insert 102 removed. As illustrated in FIGS. 6 and 7, the electronic insert 102 is a housing having side walls 610, top surface 612 and a bottom end cap 608. Within the bottom end cap 608 is a battery compartment 602 and an electronic circuit board 604 for powering and controlling an LED 108 (FIG. 8) that rests on the outside of the top surface 612 of the electronic insert 102.

Figure 8:
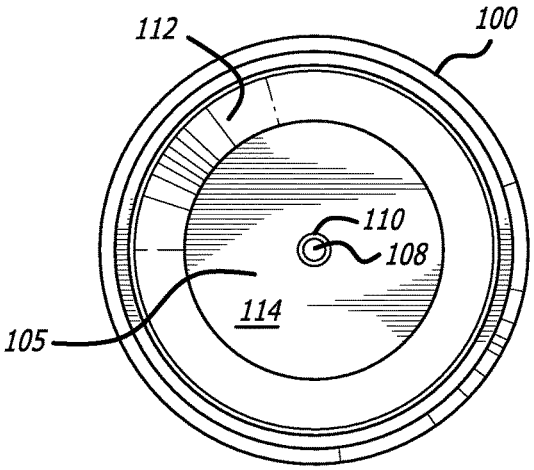
FIG. 8 is a top view of the flameless candle of FIG. 3 illustrating the LED positioned above the wax indentation but below the top of the side walls of the candle.

FIG. 8 is a top view of the flameless candle of FIG. 3 illustrating the LED 108 with a flame cap 110 positioned above a wax indentation 114 but below the top of the side walls of the candle shell 112. The LED 108 is positioned on the top surface 612 of the electronic insert 102, as illustrated in FIGS. 6 and 7.

Figure 9:
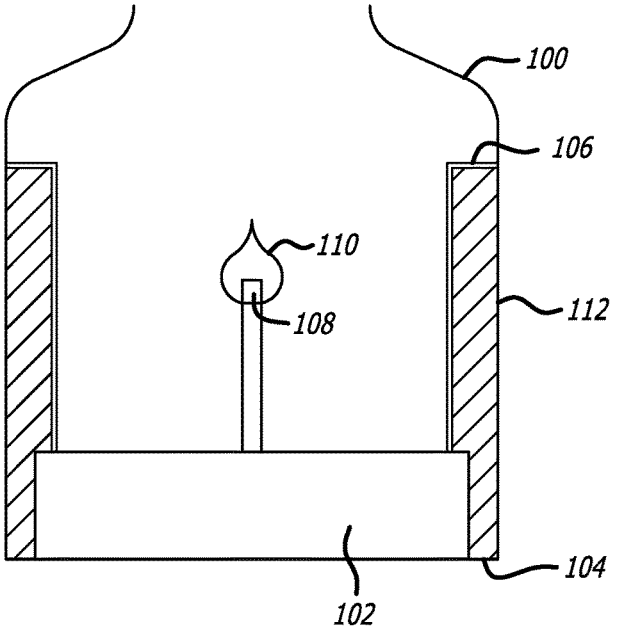
FIG. 9 is a cross-section of a flameless candle of the present invention illustrating the sidewalls being molded in the jar.
Figure 10:
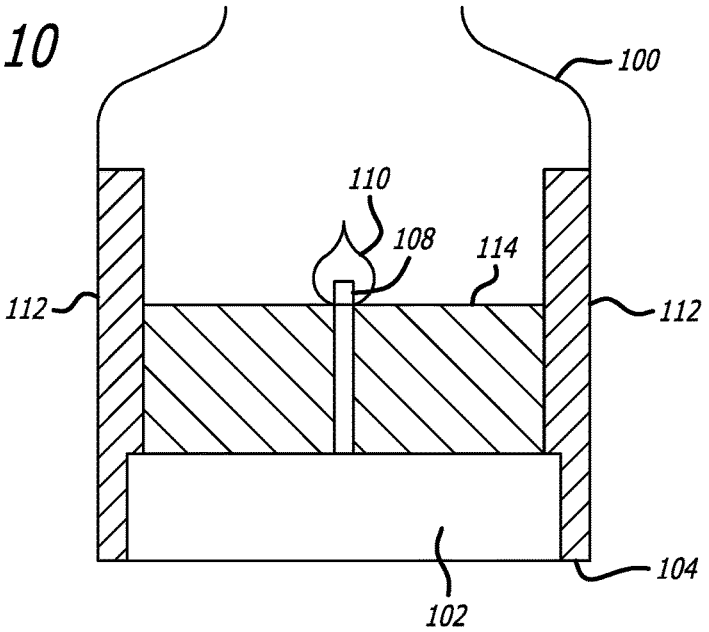
FIG. 10 is a cross-section of the flameless candle of the present invention illustrating the sidewalls and a center depressed wax portion molded in the jar.

FIGS. 9 and 10 show cross-section views of a flameless candle according to one implementation of the invention. FIG. 9 illustrates the sides 112 of the candle shell 105 being molded into the jar 100. As illustrated, the jar 100 has an open bottom for engaging an electronic insert 102, which may be defined by a ring hole 104 for engagement of the electronic insert 102. The electronic insert 102 is positioned at the open bottom of the jar 100. The electronic insert 102 includes a battery compartment 602 along with and LED 108 and a diffuser, light chamber or cap 110 that contains the LED 108. The diffuser 100 may take the form of imitation flame. In other implementations, an ornamental wick may be positioned above the LED 108.

The electronic insert 102 may be slightly smaller in circumference then the opening of the jar 100 but may include, at its edges, a snap feature 104 for securing the electronic insert to the ring hole 104 of the jar 100. Once the electronic insert 102 is fitted within the jar 100, a silicone mold 106 is positioned in the jar for creating wax or waxen sides or sidewalls 112. The silicone mold 106 has a top for preventing and stopping the flow of wax beyond a desired height. The top of the mold 106 may be designed to create a flat top on the molded sidewalls 112. To position the LED 108 within the central opening of the sidewalls 112, the sidewalls 112 are molded to extend above the LED 108 of the electronic insert 102. The candle shell sidewalls 112, when molded against the walls of the jar 100, further fills any gap between the electronic insert 102 and the walls of the jar 100 to seal the electronic insert 102 in the bottom of the jar 100.

FIG. 10 is a cross-section section of the flameless candle of the present invention illustrating the candle shell sides 112 and the center depressed wax portion 114 molded in the jar 100. As illustrated in FIG. 9, once the sidewalls 112 are formed, additional waxen or wax material 114 is poured in the center of the jar 110 to create a depression and to cover the electronic insert 102. In the illustrated example, the central wax portion 114 is poured with a top wax line just below the illumination member 110 and LED 108. In other implementation, the wax line may be just above the illumination member 110, especially when an ornamental wick is used above the LED. As illustrated, the illumination member 110 is positioned below the top of the candle shell sidewalls 112 to create a depression in the candle design and lower the LED 108 below the candle shell sidewalls 112.

While FIGS. 9 and 10 illustrate the LED elevate above the electronic insert 102, the LED 108 may rest just above the top surface 612 of the electronic insert 102, as illustrated in FIGS. 6, 7, and 8. In this case, the electronic insert 102 may be larger than illustrated in FIGS. 9 and 10 and only a small amount of wax or waxen material 114 is required to cover the top of the electronic insert 102.

In operation, a jar 100 is tooled with an open bottom having a ring hole 104 for receiving and engaging an electronic insert 102. The electronic insert 102 is then positioned within the opening at the bottom of the jar 100 and engages with the ring hole of the jar 100 through an engagement mechanism. A silicone mold 106 is then inserted in the jar 100 to create wax sidewalls 112 within the jar 100 such that the sidewalls 112 are molded to a point above the LED light 108. The mold 106 may provide for the sidewalls 112 to have a flat top. Liquid wax is then poured into the mold 106 to a point above the LED light 108. The liquid wax helps to further secure and seal the electronic insert 102 within the jar 100 when the wax dries by filling any gap between the electronic insert 102 and the glass walls of the jar 100.

The wax 112 is then allowed to cool at room temperature. The jar 100 can optionally be placed in water to cool the wax further. The silicone mold 106 is then removed from the jar 100 and the jar 100 is removed from any water (if placed in water to cool). As needed, the top of the wax line on the candle shell sidewalls 112 is smoothed flat (with a knife, for example) to remove any imperfections. Additional wax 114 is then poured on top of the electronic insert 102 to a point below the candle shell sidewalls 112. The wax 114 is then allowed to cool in the same manner as the wax is cooled for the sidewalls 112.

Alternatively, the electronic insert 102 may not be positioned within the opening at the bottom of the jar 100 until after the sidewalls 112 are poured. In this case, a silicone mold 106 is inserted in the jar 100 to create wax sidewalls 112 within the jar 100 such that the sidewalls 112 are molded to a point that will be above the LED light 108 when the electronic insert 102 is positioned in the jar 100. The mold 106 may provide for the sidewalls 112 to have a flat top. Liquid wax is then poured into the mold 106.

The wax 112 is then allowed to cool at room temperature. The jar 100 can optionally be placed in water to cool the wax further. The silicone mold 106 is then removed from the jar 100 and the jar 100 is removed from any water (if placed in water to cool). The electronic insert 102 is then placed in the jar 100 through the bottom opening in the jar 100 and positioned between the sidewalls 112 of the candle shell 105. Additional wax 114 is then poured on top of the electronic insert 102 to a point below the candle shell sidewalls 112. The wax 114 is then allowed to cool in the same manner as the wax is cooled for the sidewalls 112.

Figure 11:
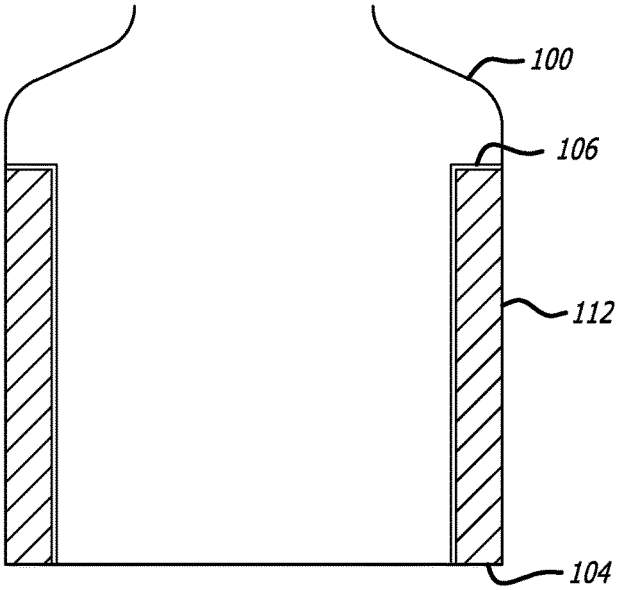
FIG. 11 is a cross-section of another example of a flameless candle of the present invention illustrating the sidewalls being molded in the jar.

FIG. 11 is a cross-section of another implementation a flameless candle of the present invention that illustrates the sidewalls 114 being molded in the jar 100 without the electronic insert positioned within the jar 100 before the sidewalls 114 are molded. As illustrated, the silicone mold 106 has a top for preventing and stopping the flow of wax beyond a desired height. The top of the mold 106 may be designed to create a flat top on the molded sidewalls 112. To position the LED 108 within the central opening of the sidewalls 112, the sidewalls 112 are molded to extend above the LED 108 of the electronic insert 102 when inserted in the jar 100.

Figure 12:
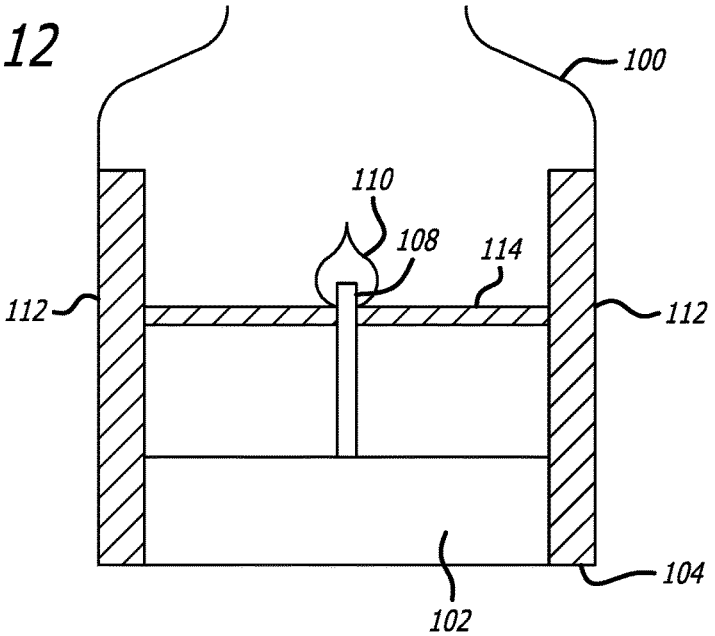
FIG. 12 is a cross-section of the flameless candle of FIG. 11 illustrating the sidewalls and a center depressed wax portion molded in the jar after the placement of the electronic insert in the jar.

FIG. 12 is a cross-section of the flameless candle of FIG. 11 illustrating the sidewalls and a center depressed wax portion molded in the jar after the placement of the electronic insert in the jar. As illustrated in FIG. 12, once the sidewalls 112 are molded, the electronic insert 102 is fitted within the jar 100 and additional wax 114 may be poured over the top of the electronic insert 102.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention include all embodiments falling within the scope of the appended claims.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

The invention claimed is:

1. A method for making a flameless candle in a jar, the method comprising the steps of:

tooling an opening in a bottom of the jar for engaging an electronic insert having a LED light;

engaging an electronic insert within the ring hole opening in the jar;

placing a silicone mold in the jar to mold the candle shell wax sidewalls within the jar, where the sidewalls form a hollow central opening extending the length of the sidewalls, and where the silicone mold extends above the position of the LED light of the electronic insert;

pouring liquid wax into the mold to a point above the position of the LED light of the electronic insert;

cooling the wax;

removing the silicone mold; and pouring additional wax within the candle shell sidewall above the electronic insert to a position just above or below the LED but lower than the top of the candle shell sidewalls.

2. A method for making a flameless candle in a jar, the method comprising the steps of:

tooling an opening in a bottom of the jar for engaging an electronic insert having a LED light;

placing a silicone mold in the jar to mold candle shell wax sidewalls within the jar, where the sidewalls form a hollow central opening extending the length of the sidewalls, and where the silicone mold will extend above the position of the LED light of the electronic insert when inserted into the jar;

pouring liquid wax into the mold to a point above the position of the LED light of the electronic insert when inserted into the jar;

cooling the wax;

removing the silicone mold;

engaging an electronic insert within the ring hole opening in the jar; and pouring additional wax within the candle shell sidewall above the electronic insert to a position just above or below the LED but lower than the top of the candle shell sidewalls.

* * * * *